US011519197B2

(12) United States Patent
Bannister

(10) Patent No.: US 11,519,197 B2
(45) Date of Patent: Dec. 6, 2022

(54) LOCKABLE BOLT DEVICE

(71) Applicant: Raymond Bannister, Lime Springs, IA (US)

(72) Inventor: Raymond Bannister, Lime Springs, IA (US)

( * ) Notice: Subject to any disclaimer, the term of this patent is extended or adjusted under 35 U.S.C. 154(b) by 720 days.

(21) Appl. No.: 16/241,104

(22) Filed: Jan. 7, 2019

(65) Prior Publication Data

US 2019/0264463 A1 Aug. 29, 2019

Related U.S. Application Data

(60) Provisional application No. 62/636,269, filed on Feb. 28, 2018.

(51) Int. Cl.
*E05B 15/02* (2006.01)
*E05B 9/00* (2006.01)
(Continued)

(52) U.S. Cl.
CPC ..... *E05B 15/0205* (2013.01); *E05B 9/002* (2013.01); *E05C 1/04* (2013.01); *E05B 63/0052* (2013.01); *E05B 2015/0285* (2013.01)

(58) Field of Classification Search
CPC ..... Y10T 292/096; Y10T 292/1022; Y10T 292/1023; Y10T 292/1024; Y10T 292/1025; Y10T 292/1028; Y10T 292/23; Y10T 292/313; Y10T 292/314; Y10T 292/34; Y10T 292/37; Y10T 292/379; Y10T 292/388; Y10T 292/65; Y10T 292/67; E05B 15/02; E05B 15/0205; E05B 63/0052; E05B 2015/0285; E05B 9/002; E05C 1/02; E05C 1/04; E05C 19/003;
(Continued)

(56) References Cited

U.S. PATENT DOCUMENTS 177,674 A * 5/1876 Adams ..... E05C 1/04 292/57
584,677 A * 6/1897 Doyle ..... E05C 19/182 292/292
(Continued)

FOREIGN PATENT DOCUMENTS

GB 2494229 A * 3/2013 ..... E05B 45/083

*Primary Examiner* — Christine M Mills
*Assistant Examiner* — Peter H Watson
(74) *Attorney, Agent, or Firm* — Boudwin Intellectual Property; Daniel Boudwin

(57) ABSTRACT

A lockable bolt device for an interior of a door. The lockable bolt device includes a door attachment plate having a horizontal aperture therethrough, configured to securely attach to the door, and a jamb attachment plate having two horizontal apertures therethrough, configured to securely attach to a door jamb. The jamb attachment plate also includes a vertical aperture therethrough, such that the vertical aperture is configured to removably accept an angled bolt therethrough for storage of the angled bolt when the lockable bolt device is in an unlocked configuration. When the door is in a closed position and the horizontal apertures are aligned, the two plates are configured to accept the angled bolt through the horizontal apertures to secure the door in the closed position. The lockable bolt device is useful to prevent an individual from passing through the door from an exterior of the door.

8 Claims, 3 Drawing Sheets

(51) Int. Cl.
*E05C 1/04* (2006.01)
*E05B 63/00* (2006.01)

(58) Field of Classification Search
CPC ..... E05C 19/18; E05C 19/184; E05C 19/188; Y10S 292/30
See application file for complete search history.

(56) References Cited

U.S. PATENT DOCUMENTS

| | | | | |
|---|---|---|---|---|
| 2,403,065 | A * | 7/1946 | Engert | E05C 1/04 292/57 |
| 2,794,663 | A * | 6/1957 | Grodt | E05C 3/167 292/67 |
| 4,014,571 | A | 3/1977 | Ellis | |
| 5,080,354 | A | 1/1992 | McDougall | |
| 5,427,422 | A | 6/1995 | Madlener et al. | |
| 6,684,570 | B1 | 2/2004 | Robledo | |
| 7,648,180 | B2 | 1/2010 | Petry | |

* cited by examiner

LOCKABLE BOLT DEVICE

CROSS REFERENCE TO RELATED APPLICATIONS

This application claims priority under 35 U.S.C. § 119(e) to U.S. Provisional Application No. 62/636,269 filed on Feb. 28, 2018. The above identified patent application is incorporated by reference herein in its entirety to provide continuity of disclosure.

BACKGROUND OF THE INVENTION

The present invention relates to a lockable bolt device for a door.

Many conventional locking mechanisms for locking a door in a closed position, including deadbolts, knob locks, handle locks, cam locks, safety chains, and the like, can be bypassed by any of a variety of means. Bypassing conventional door locking mechanisms may be achieved by picking, cutting, or breaking the locking mechanism. Bypassing may be part of an attempt by an unwanted or unauthorized individual to gain entry to a building, room, or other structure by passing through the door having the conventional locking mechanism.

Therefore, there is a need in the art for a new and improved locking mechanism for securely locking a door in a closed position, such that entry from the exterior is prevented. The present invention addresses this unmet need.

Devices have been disclosed in the art that relate to lockable bolt devices. These include devices that have been patented and published in patent application publications. These devices are often able to be bypassed by methods, devices, or other means known in the art. In view of the devices disclosed in the art, it is submitted that there is a need in the art for an improvement to existing lockable bolt devices. In view of the present disclosure, it is submitted that the present invention substantially diverges in structural and functional elements from devices in the art, and the present invention substantially fulfills an unmet need in the art.

SUMMARY OF THE INVENTION

In view of the disadvantages inherent in the known types of lockable bolt devices in the art, the present invention provides a new and improved lockable bolt device, wherein the same can be utilized for locking or securing a door in a closed position.

It is therefore an object of the present invention to provide a lockable bolt device for securing the door in the closed position.

In one aspect, the invention provides a lockable bolt device for a door, having a door attachment plate, a jamb attachment plate, and an angled bolt. The door attachment plate is attachable to a door, and the jamb attachment plate is attachable to a jamb of a door frame of the door. The door attachment plate and the jamb attachment plate together include a plurality of horizontal apertures, configured to align and removably accept the angled bolt therethrough to place the lockable bolt device in a locked configuration and secure the door in the closed position. In addition, the jamb attachment plate includes a vertical aperture, which is configured to removably accept the angled bolt therethrough, in order to store the angled bolt when the lockable bolt device is in an unlocked configuration.

In another aspect, the invention provides a lockable bolt device for a door, comprising a cylindrical bolt and a jamb attachment plate. The jamb attachment plate includes a cylindrical bolt receiver attached thereto, and the cylindrical bolt receiver is configured to receive the cylindrical bolt therein.

Another object of the present invention is to provide a lockable bolt device that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
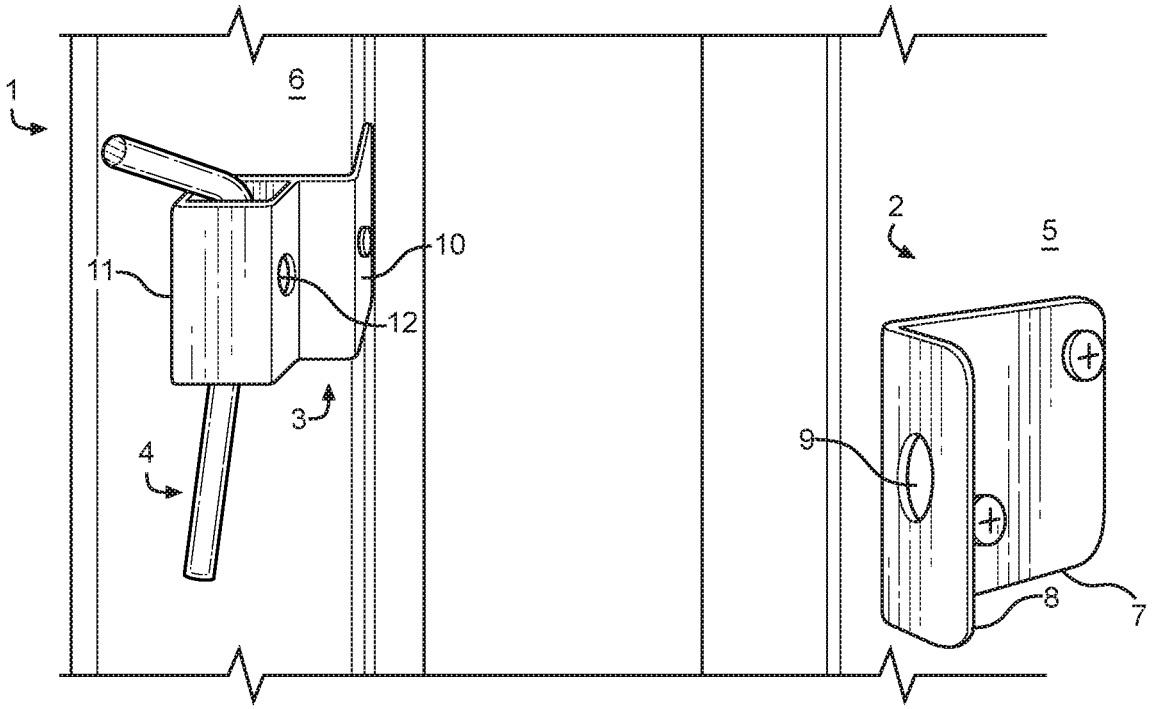
FIG. 1 depicts a perspective view of a first exemplary lockable bolt device, in an unlocked configuration, with an angled bolt in a vertical aperture of a jamb attachment plate.

Reference is made herein to the attached drawings. Like reference numerals are used throughout the drawings to depict like or similar elements of the portable air filtration device and method. The figures are intended for representative purposes only and should not be considered limiting in any respect.

Reference is now made to the drawings, which depict one or more exemplary embodiments of the invention.

Figure 2:
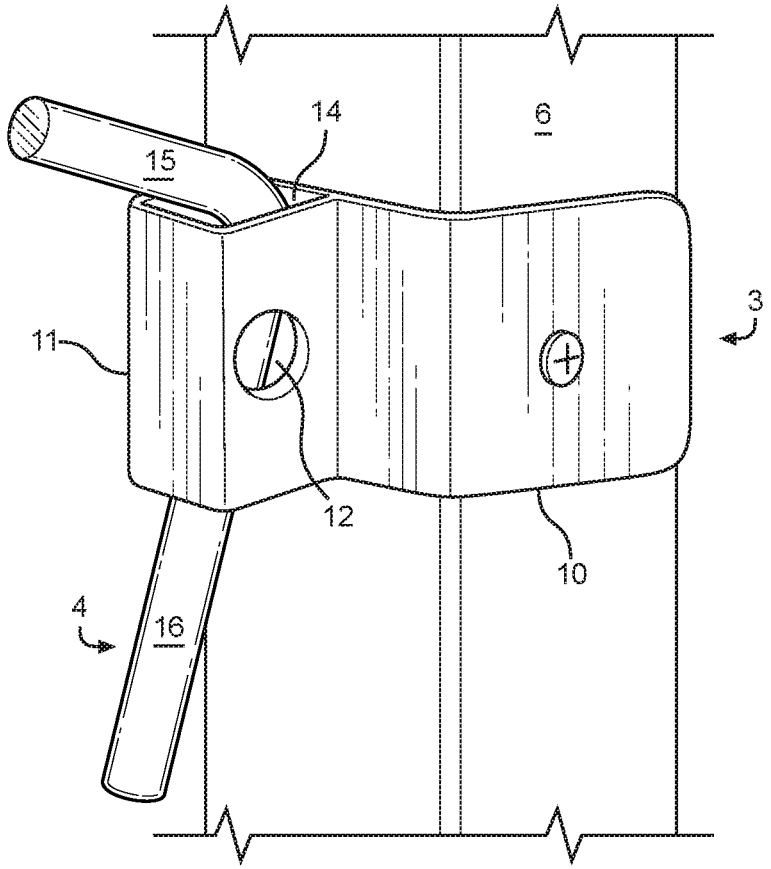
FIG. 2 depicts a close-up perspective view of the angled bolt and the jamb attachment plate of the first exemplary lockable bolt device in the unlocked configuration.

Referring now to FIGS. 1 and 2, there are depicted a perspective view of a first exemplary lockable bolt device (FIG. 1), and a close-up perspective view of an angled bolt and a jamb attachment plate of the first exemplary lockable bolt device (FIG. 2), in an unlocked configuration, with the angled bolt in a vertical aperture of the jamb attachment plate. The lockable bolt device 1 includes a door attachment plate 2, a jamb attachment plate 3, and an angled bolt 4. In the shown embodiment, the door attachment plate 2 and the jamb attachment plate 3 are attached to a door 5 and a jamb 6 of a door frame of the door 5, respectively, and the door 5 is in an open position. A hinge or a set of hinges of the door 5 is positioned toward a right side of FIG. 1, and is not depicted. In the shown embodiment, the angled bolt 4 is placed within a vertical aperture 14 of the jamb attachment plate 3, to store the angled bolt 4 when not in use to secure the lockable attachment device 1 in a locked configuration. In this manner, the angled bolt 4 is not misplaced or lost when not in use.

In the shown embodiment, if the door attachment plate 2 is attached to the door 5 and if the jamb attachment plate 3 is attached to the jamb 6, and if the door 5 is in a closed position, a plurality of horizontal apertures align to removably accept an insertable portion of the angled bolt 4 therethrough to secure the door 5 in the closed position.

The door attachment plate 2 includes a door attachment wall 7, and a bolt acceptor wall 8 having a horizontal aperture 9 therethrough. The door attachment wall 7 is perpendicular to the bolt acceptor wall 8 and is attachable to the door 5. The horizontal aperture 9 is configured to removably accept the insertable portion of the angled bolt 4 therethrough. The jamb attachment plate 3 includes a jamb attachment wall 10, and a bolt acceptor member 11 having two horizontal apertures therethrough and the vertical aperture 14 therethrough. The jamb attachment wall 10 is perpendicular to the bolt acceptor member 11 and is attachable to the jamb 6. The two horizontal apertures, including an inward aperture 12 and an outward aperture, are also configured to removably accept the insertable portion of the angled bolt 4 therethrough. In this manner, the door 5 may be placed in the open position when individuals, animals, or objects must pass through the frame of the door 5, and the door 5 may be secured in the closed position by the lockable bolt device 1 when not in use or when a security of the door 5 must be elevated.

In some embodiments, the jamb attachment wall 10 is attachable to a frame structure of a wall adjacent to the jamb 6 of the door frame of the door 5, thereby improving a security of the lockable bolt device 1 by increasing a magnitude of a force required to break open the door 5 when secured in the closed position by the lockable bolt device 1. The frame structure of the wall may include a solid wood beam, such as a vertical frame beam, for example.

In the shown embodiment, the bolt acceptor member 11 is formed by four vertical walls attached to each other to form the vertical aperture 14, such that three of the four vertical walls are equal in size, and such that one of the four vertical walls has a size that is greater than the size of the three of the four vertical walls. The one of the four vertical walls, having the greater size relative to the three of the four vertical walls, is connected to the jamb attachment wall 10. In the shown embodiment, the vertical aperture 14 includes a square cross section throughout a majority of a height of the vertical aperture 14. In this manner, manufacturing the vertical aperture 14 is facilitated.

In the shown embodiment, the angled bolt 4 includes a long portion 16 and a short portion 15, such that the long portion 16 and the short portion 15 are perpendicular to each other, and the insertable portion includes the long portion 16. In the shown embodiment, the insertable portion of the angled bolt 4 is placed within the vertical aperture 14, thereby storing the angled bolt 4 when not in use. In the shown embodiment, a thickness of the long portion 16 is equal to a thickness of the short portion 15. In some embodiments, the angled bolt 4 is comprised of 0.5-inch round stainless steel. In this manner, a strength and a durability of the angled bolt 4 is maximized, and manufacturing the angled bolt 4 is facilitated.

Figure 3:
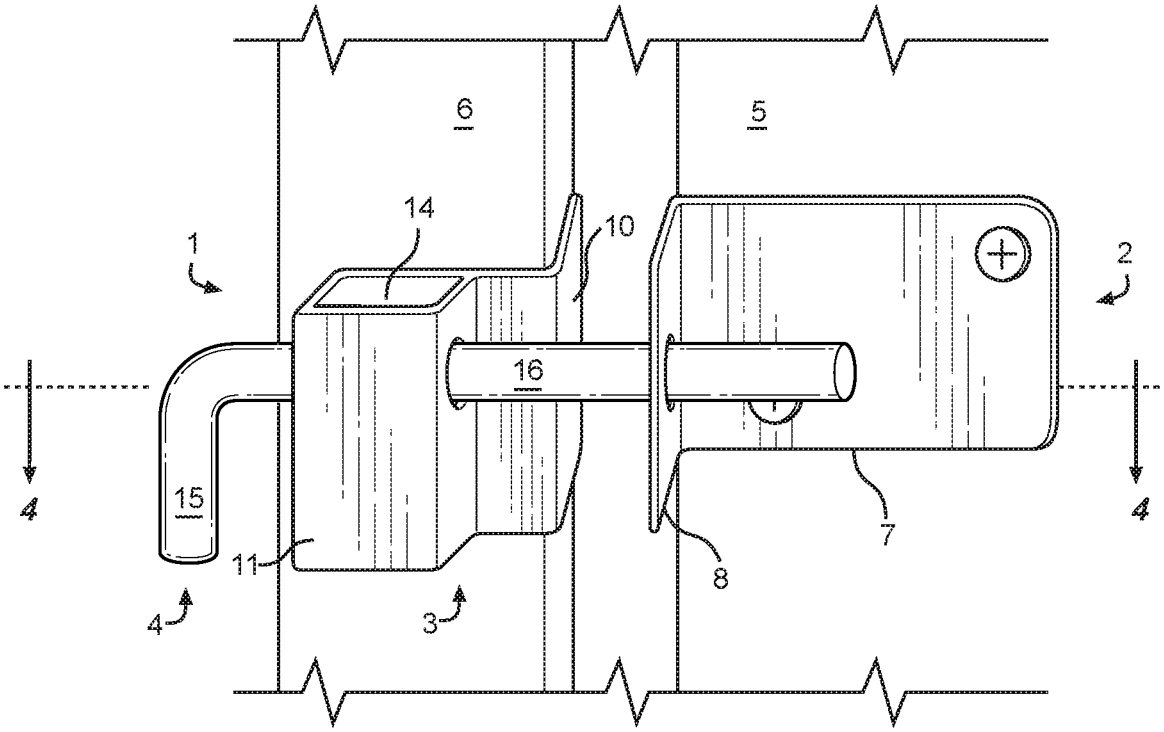
FIG. 3 depicts a front perspective view of the first exemplary lockable bolt device, in a locked configuration, with the angled bolt in a plurality of horizontal apertures of the jamb attachment plate and a door attachment plate.
Figure 4:
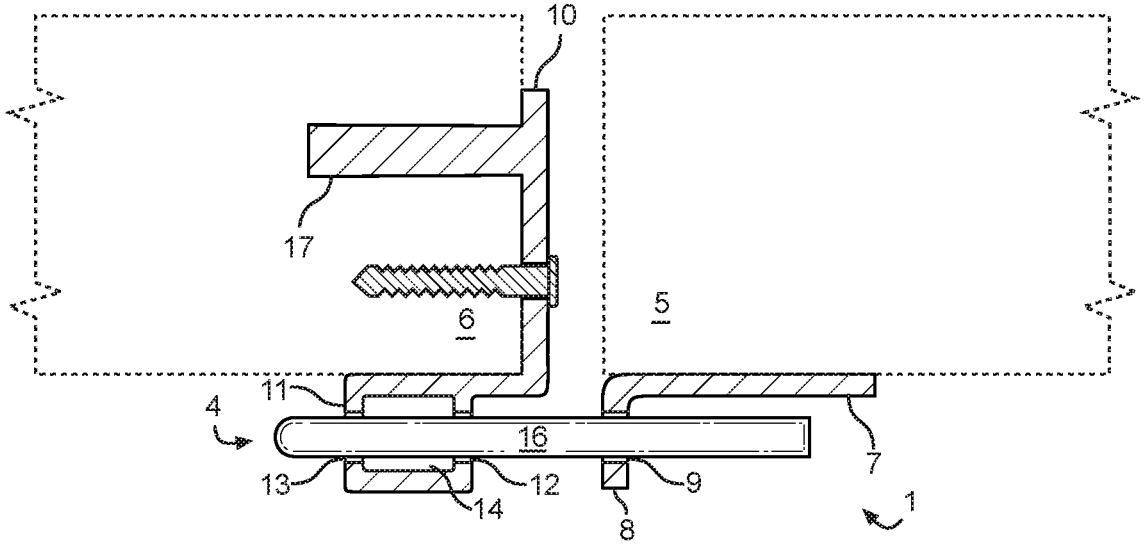
FIG. 4 depicts a top-down cross section view of the first exemplary lockable bolt device in the locked configuration.

Referring now to FIGS. 3 and 4, there are depicted a front perspective view (FIG. 3) and a top-down cross section view (FIG. 4) of the first exemplary lockable bolt device, in a locked configuration, with the angled bolt in the plurality of horizontal apertures of the jamb attachment plate and a door attachment plate. In the shown embodiment of the lockable bolt device 1, the door attachment plate 2 is attached to the door 5, the jamb attachment plate 3 is attached to the jamb 6, and the angled bolt 4 is placed in the plurality of horizontal apertures (9, 12, 13). In this manner, the lockable bolt device 1 secures the door 5 to the jamb 6, thereby preventing access to an interior of the door 5 from an exterior of the door 5.

Generally, the door attachment plate 2 is attached to the door 5 and the jamb attachment plate 3 is attached to the jamb 6 such that the bolt acceptor wall 8 is proximal to the bolt acceptor member 11 relative to the door attachment wall 7, and such that the jamb attachment wall 10 is proximal to the bolt acceptor wall 8 relative to the bolt acceptor member 11. The iamb attachment wall 10 further includes an elongated member 17. The elongated member 17 is affixed to the iamb attachment wall 10, whereby the elongated member 17 is perpendicular to the iamb attachment wall 10 and the elongated member 10 is parallel with the jamb attachment plate 2. The elongated member 17 inserts into the jamb 6. In this manner, a sheer force on the angled bolt 4, caused by an externally applied force on an exterior surface of the door 5, for example, as part of an attempt to break the angled bolt 4 when in the locked configuration, is prevented from bending the angled bolt 4, which could compromise the security of the lockable bolt device 1. Further, the lockable bolt device 1 may be installed either on a left side of the door 5 or a right side of the door 5, but generally, should be installed on a side of the door 5 opposite to a side of the door 5 having a hinge or a set of hinges thereon. In this manner, a magnitude of the externally applied force required to break through the door 5 when secured by the lockable bolt device 1 is maximized, thereby improving the security of the lockable bolt device 1.

In the shown embodiment, the two horizontal apertures (12, 13) of the bolt acceptor member 11, and the horizontal aperture 9 of the bolt acceptor wall 8, are equal in size. Further, the vertical aperture 14 of the bolt acceptor member 11 has a size that is greater than the size of the two horizontal apertures (12, 13) of the bolt acceptor member 11 and that is greater than the size of the horizontal aperture 9 of the bolt acceptor wall 8. In this manner, manufacturing the lockable bolt device 1 is facilitated.

In some embodiments, if the door attachment plate 2 is attached to the door 5 and if the jamb attachment plate 3 is attached to the jamb 6, and if the door 5 is in the closed position, a path of all of the aligned horizontal apertures (i.e., the plurality of horizontal apertures 9, 12, 13) is parallel to a bottom of the door 5. In this manner, the angled bolt 4 may be secured within the plurality of horizontal apertures (9, 12, 13) by a static friction caused by a gravitational force applied to the angled bolt 4, and may also be secured within the plurality of horizontal apertures (9, 12, 13) by a friction fit.

In other embodiments, if the door attachment plate 2 is attached to the door 5 and if the jamb attachment plate 3 is attached to the jamb 6, and if the door 5 is in the closed position, a path of all of the aligned horizontal apertures (i.e., the plurality of horizontal apertures 9, 12, 13) is not parallel to the bottom of the door 5. In this manner, the angled bolt 4 may be secured within the plurality of horizontal apertures (9, 12, 13) by the gravitational force, which presses the short portion 15 of the angled bolt 4 against a portion of the lockable bolt device 1 adjacent to either the horizontal aperture 9 or the horizontal aperture 13, depending on from which side the long portion 16 of the angled bolt 4 was inserted. In this manner, a jostling of the door 5 is not sufficient to knock or slide the angled bolt 4 out of the plurality of horizontal apertures (9, 12 13), and the security of the lockable bolt device 1 is improved.

Figure 5:
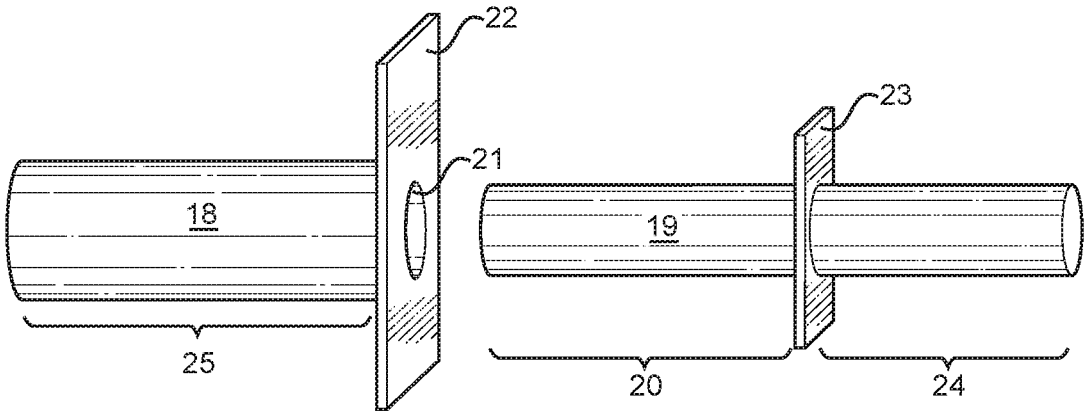
FIG. 5 depicts a front perspective view of a second exemplary lockable bolt device in an unlocked configuration.
Figure 6:
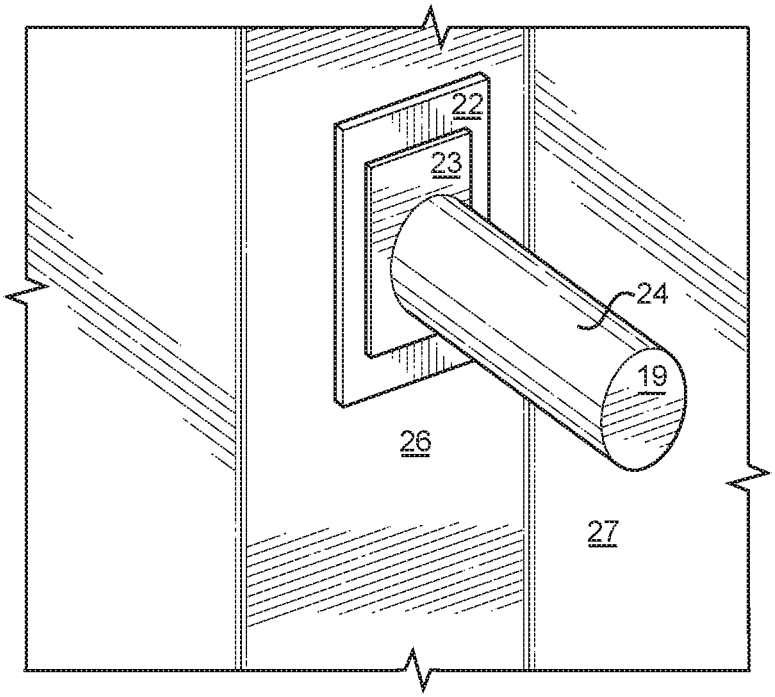
FIG. 6 depicts a side perspective view of the second exemplary lockable bolt device in a locked configuration.

Referring now to FIGS. 5 and 6, there are depicted a front perspective view of a second exemplary lockable bolt device in an unlocked configuration (FIG. 5), and a side perspective view of the second exemplary lockable bolt device in a locked configuration (FIG. 6). The second exemplary lockable bolt device includes a cylindrical bolt 19 and a jamb attachment plate 22. The jamb attachment plate 22 includes a cylindrical bolt receiver 18 attached thereto, and the cylindrical bolt receiver 18 is configured to receive the cylindrical bolt 19 therein. In a particular embodiment, the cylindrical bolt receiver 18 is installed into a solid structure 26 adjacent to a door 27 that opens inward (i.e., toward the lockable bolt device). In this manner, when the cylindrical bolt 19 is inserted into the cylindrical bolt receiver 18 (FIG. 6), the lockable bolt device is in a locked configuration. Similarly, when the cylindrical bolt 19 is not inserted into the cylindrical bolt receiver 18 (FIG. 5), the lockable bolt device is in an unlocked configuration. This configuration provides a high degree of security to prevent an individual exterior to the door 27 from entering to an interior of the door 27, by passing through the door 27.

Generally, a receiving portion 25 of the cylindrical bolt receiver 18 is sized and configured to receive a forward portion 20 of the cylindrical bolt 19. A rearward portion 24 of the cylindrical bolt 19 is rearward of a stop plate 23, which is attached to the cylindrical bolt 19 at an intermediate position thereof. The stop plate 23 is configured to engage the jamb attachment plate 22 when in the locked configuration. In this manner, an individual using the lockable bolt device may grasp the rearward portion 24 to insert or remove the forward portion 20 into or from the receiving portion 25, respectively.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A lockable bolt device for a door, comprising:

a door attachment plate, having a door attachment wall and a bolt acceptor wall having a first horizontal aperture therethrough, wherein the door attachment wall is perpendicular to the bolt acceptor wall and is attachable to the door, wherein the first horizontal aperture is configured to removably accept an insertable portion of an angled bolt therethrough;

a jamb attachment plate, having a jamb attachment wall and a bolt acceptor member, whereby the bolt acceptor member comprises a first plate, a second plate, and a third plate;

wherein the first plate of the bolt acceptor member and the second plate of the bolt acceptor member extend outwardly from the jamb attachment wall and the third plate of the bolt acceptor member connects the first plate and the second plate, wherein the third plate of the bolt acceptor member is parallel with the jamb attachment plate, whereby the first plate, the second plate, the third plate, and the jamb attachment wall define a vertical aperture;

wherein the first plate of the bolt acceptor member comprises a second horizontal aperture and the second plate of the bolt acceptor member comprises a third horizontal aperture;

wherein the jamb attachment wall extends from the bolt acceptor member and angles perpendicularly from the bolt acceptor member at a 90-degree angle with respect to a planar face of the bolt accepter member, whereby the jamb attachment wall is contacting an interior side of a jamb and the bolt acceptor member is contacting an adjacent exterior side of the jamb, wherein the second horizontal aperture, the third horizontal aperture, and the vertical aperture are configured to removably accept the insertable portion of the angled bolt therethrough;

an elongated member affixed to the jamb attachment wall, whereby the elongated member is perpendicular to the jamb attachment wall and the elongated member is parallel with the jamb attachment plate, whereby the jamb attachment wall extends a length beyond the elongated member defining a lip of the jamb attachment wall, wherein the elongated member inserts into the jamb and a supporting wall adjacent to the jamb and the lip of the jamb attachment wall is positioned on the interior side of the jamb;

wherein if the door attachment plate is attached to the door and if the jamb attachment plate is attached to the jamb, and if the door is in a closed position, all of the horizontal apertures are configured to align to removably accept the insertable portion of the angled bolt therethrough to secure the door in the closed position and the jamb attachment wall is sandwiched between the jamb and the door.

2. The lockable bolt device of claim 1, wherein the jamb attachment wall is attachable to a frame structure of a wall adjacent to the jamb of the door frame of the door.

3. The lockable bolt device of claim 1, wherein the second and the third horizontal apertures of the bolt acceptor member and the first horizontal aperture of the bolt acceptor wall are equal in size.

4. The lockable bolt device of claim 1, wherein the vertical aperture of the bolt acceptor member is sized to be larger than the second and the third horizontal apertures of the bolt acceptor member and the first horizontal aperture of the bolt acceptor wall.

5. The lockable bolt device of claim 1, wherein the vertical aperture includes a square cross section throughout a majority of a height of the vertical aperture.

6. The lockable bolt device of claim 1, wherein the angled bolt comprises a long portion and a short portion, whereby the long portion is perpendicular to the short portion forming a right angle, whereby a thickness of the long portion is equal to a thickness of the short portion.

7. The lockable bolt device of claim 1, wherein if the door attachment plate is attached to the door and if the jamb attachment plate is attached to the jamb, and if the door is in the closed position, a path of all of the aligned horizontal apertures is parallel to a bottom of the door.

8. The lockable bolt device of claim 1, wherein if the door attachment plate is attached to the door and if the jamb attachment plate is attached to the jamb, and if the door is in the closed position, a path of all of the aligned horizontal apertures is not parallel to a bottom of the door.

* * * * *